US006059545A

United States Patent [19]

Straub et al.

[11] Patent Number: 6,059,545

[45] **Date of Patent: *May 9, 2000**

[54] FUEL PUMP CONTROL VALVE ASSEMBLY

[75] Inventors: Robert D. Straub, Lowell; Werner Faupel, Wyoming, both of Mich.

[73] Assignee: Diesel Technology Company, Kentwood, Mich.

[ * ] Notice: This patent is subject to a terminal disclaimer.

[21] Appl. No.: 09/364,361

[22] Filed: Jul. 30, 1999

Related U.S. Application Data

[60] Division of application No. 08/911,819, Aug. 15, 1997, Pat. No. 5,954,487, which is a continuation-in-part of application No. 08/650,658, May 20, 1996, abandoned, which is a continuation of application No. 08/493,949, Jun. 23, 1995, abandoned.

[51] Int. Cl.[7] ..... F04B 7/00

[52] U.S. Cl. ..... 417/505; 251/50; 251/64

[58] Field of Search ..... 417/505; 123/506, 123/467; 251/64, 129.18, 129.21, 50, 322

[56] References Cited

U.S. PATENT DOCUMENTS

| | | |
|---|---|---|
| 2,019,650 | 11/1935 | Bischof . |
| 2,022,643 | 11/1935 | Hueber et al. . |
| 2,190,464 | 2/1940 | Wile . |
| 2,770,394 | 11/1956 | Muller . |
| 3,556,464 | 1/1971 | Griswold . |
| 3,779,225 | 12/1973 | Watson et al. . |
| 3,810,485 | 5/1974 | Gawlick et al. . |
| 3,958,902 | 5/1976 | Toyoda et al. . |
| 4,161,161 | 7/1979 | Bastenhof . |
| 4,174,693 | 11/1979 | Steinwart et al. . |
| 4,214,565 | 7/1980 | Knapp et al. . |
| 4,269,361 | 5/1981 | Seilly . |
| 4,303,096 | 12/1981 | Skinner . |
| 4,417,693 | 11/1983 | Füssner et al. . |
| 4,485,843 | 12/1984 | Wolff . |
| 4,501,246 | 2/1985 | LeBlanc . |
| 4,569,641 | 2/1986 | Falk et al. . |
| 4,618,095 | 10/1986 | Spoolstra . |
| 4,619,239 | 10/1986 | Wallenfang et al. . |
| 4,627,571 | 12/1986 | Kato et al. . |
| 4,628,727 | 12/1986 | Seaman et al. . |
| 4,730,585 | 3/1988 | Abe et al. . |
| 4,747,545 | 5/1988 | Trachte et al. . |
| 4,782,807 | 11/1988 | Takahashi . |
| 4,829,967 | 5/1989 | Nati . |
| 4,889,288 | 12/1989 | Gaskell . |
| 4,911,366 | 3/1990 | Priesner . |
| 4,917,065 | 4/1990 | Law et al. . |
| 4,957,275 | 9/1990 | Homes . |
| 4,979,674 | 12/1990 | Taira et al. . |
| 4,986,728 | 1/1991 | Fuchs . |
| 5,025,768 | 6/1991 | Eckert . |
| 5,062,449 | 11/1991 | Woollums et al. . |
| 5,118,076 | 6/1992 | Homes . |
| 5,125,807 | 6/1992 | Kohler et al. . |
| 5,241,935 | 9/1993 | Beck et al. . |
| 5,341,783 | 8/1994 | Beck et al. . |
| 5,345,916 | 9/1994 | Amann et al. . |
| 5,373,828 | 12/1994 | Askaw . |
| 5,385,455 | 1/1995 | Dinsmore et al. . |
| 5,423,484 | 6/1995 | Zuo . |
| 5,425,341 | 6/1995 | Connolly et al. . |
| 5,427,352 | 6/1995 | Brehm . |
| 5,441,029 | 8/1995 | Hlousek ..... 123/467 |

(List continued on next page.)

FOREIGN PATENT DOCUMENTS

| | | |
|---|---|---|
| 0803 648 A1 | 10/1997 | European Pat. Off. . |
| WO97/01031 | 1/1997 | WIPO . |

*Primary Examiner*—Charles G. Freay
*Attorney, Agent, or Firm*—Brooks & Kushman P.C.

[57] ABSTRACT

A fuel pump or injector has a control valve with a piston valve body axially movable over a motion displacement interval defined by first and second sub-intervals. A first control valve spring causes the piston valve body to be biased toward the unactuated position whenever the piston valve body is in the first sub-interval. A second control valve spring causes the piston valve body to be biased into damped engagement with the valve stop whenever the piston valve body is in the second sub-interval.

24 Claims, 5 Drawing Sheets

U.S. PATENT DOCUMENTS 5,464,334 11/1995 Cook et al. .
5,494,219 2/1996 Maley et al. .
5,517,972 5/1996 Stockner .
5,524,826 6/1996 Mueller et al. .
5,533,481 7/1996 Kronberger .
5,562,428 10/1996 Bailey et al. .
5,566,660 10/1996 Camplin et al. .
5,619,969 4/1997 Liu et al. .
5,632,444 5/1997 Camplin et al. .
5,647,536 7/1997 Yen et al. .
5,651,501 7/1997 Maley et al. .
5,662,087 9/1997 McCandless .
5,669,356 9/1997 Wall et al. .
5,673,853 10/1997 Crofts et al. .
5,685,490 11/1997 Ausman et al. .
5,694,903 12/1997 Ganser .
5,706,778 1/1998 Kapus .
5,709,341 1/1998 Graves .
5,711,277 1/1998 Fuseya .
5,727,738 3/1998 Hofmann et al. .
5,730,104 3/1998 Hafner .
5,730,261 3/1998 Spakowski et al. .
5,738,075 4/1998 Chen et al. .
5,749,717 5/1998 Straub et al. ..... 417/505
5,752,659 5/1998 Moncelle .
5,765,755 6/1998 Peters et al. .
5,769,319 6/1998 Yen et al. .
5,775,301 7/1998 Ganser ..... 123/467
5,803,370 9/1998 Heinz et al. .
5,860,597 1/1999 Tarr .
5,865,213 2/1999 Scheffel et al. ..... 137/614.16
5,868,317 2/1999 English .
5,954,487 9/1999 Straub et al. ..... 417/505

FUEL PUMP CONTROL VALVE ASSEMBLY

This is a divisional of application Ser. No. 08/911,819, filed on Aug. 15, 1997, now U.S. Pat. No. 5,954,487 which is a continuation-in-part of application Ser. No. 08/650,658, filed on May 20, 1996, now abandoned, which is a continuation of application Ser. No. 08/493,949 filed on Jun. 23, 1995, now abandoned.

TECHNICAL FIELD

The present invention relates to a fuel pump control valve assembly and method of operating same for dampening control valve motion in a heavy duty truck diesel fuel injection system including either a unit pump or unit fuel injectors.

BACKGROUND ART

Fuel control valve assemblies in vehicular fuel injection systems, typically include a housing having a control valve chamber, a control valve having a piston valve body, and a valve stop. Electromagnetic actuators are commonly used in control valve assemblies for electronically controlling actuation of the control valve. Examples are shown in U.S. Pat. Nos. 4,618,095, assigned to the assignee of the present invention, and 4,501,246.

A primary disadvantage associated with existing control valve assemblies, including those with electronically actuated control valves, is the fact that upon contact of the control valve with the control valve stop, the control valve "bounces" off the valve stop in diminishing series fashion as illustrated in FIG. 7*a* before finally opening. This control valve "bounce" can significantly lessen the precision of the fuel flow process, and thereby the combustion efficiency.

For the foregoing reasons, there is a need for a control valve assembly that overcomes the problems and limitations of the prior art.

DISCLOSURE OF THE INVENTION

It is, therefore, an object of the present invention to provide an improved control valve assembly.

It is another object of the present invention to provide an improved control valve assembly for more precisely controlling valve displacement over unit time by varying the rate of displacement per unit time.

It is a further object of the present invention to provide such an improved control valve assembly for controlling fuel in fuel pumps and fuel injectors for internal combustion engines and being able to slow, and thereby damp, the control valve at the end of the injection stroke.

The present invention also contemplates such a control valve assembly wherein the damping of the control valve at one or both ends of its stroke may be controlled electronically by adjusting current levels to the control valve armature coil and the use of this control technique particularly in pilot injection type fuel injection systems thereby facilitating precise control over the initiation of the main injection by the precise control of the end of the preceding pilot injection illustrated as $t_2$ in FIGS. 7*b* and 7*c*.

In carrying out the above objects and other objects and features of the present invention, a control valve assembly and method for controlling valve motion are provided. The control valve assembly comprises a housing having a control valve disposed in a control valve chamber. The control valve includes a piston valve body axially movable over a motion displacement interval between first and second positions within the control valve chamber. The motion displacement interval is defined by first and second sub-intervals that are each bounded on one end by the first and second positions, respectively. The piston valve body includes a piston valve body seat. The piston valve body seat contacts a pump body seating surface whenever the piston valve body is in the first position.

A valve stop is disposed in the housing adjacent the control valve chamber. The piston valve body seat contacts the valve stop whenever the piston valve body is in the second position. A first control valve spring causes the piston valve body to be biased toward the second position whenever the piston valve body is in the first sub-interval. A second control valve spring causes the piston valve body to be biased into damped engagement with the valve stop whenever the piston valve body is in the second sub-interval.

In another embodiment, the control valve assembly includes means for actuating the control valve, such as an electromagnetic actuator or solenoid. The piston valve body is urged toward an actuated position whenever the control valve is in an actuated state. The actuated position can be either the first or second position, and an unactuated position is the other of the first and second positions. The first control valve spring causes the piston valve body to be biased toward the unactuated position whenever the piston valve body is in the first sub-interval. The second control valve spring causes the piston valve body to be biased into damped engagement with the valve stop whenever the piston valve body is in the second sub-interval.

Upon deactuation of the control valve, the piston valve body is urged toward the second position, and into damped engagement with the valve stop.

Many configurations are possible for the first and second control valve springs in accordance with the present invention. For example, the first control valve spring could alternatively be configured to cause the piston valve body to be biased toward the second position when the piston valve body is in the second sub-interval, in addition to whenever the piston valve body is in the first sub-interval. The second control valve spring could be configured to cause the piston valve body to be biased toward the first position when the piston valve body is in the second sub-interval, or alternatively, the second control valve spring could be configured to cause the piston valve body to be biased toward the second position when the piston valve body is in the second sub-interval. The direction which the second control valve spring causes the piston valve body to be biased, for a particular configuration, is determined accordingly so as to bring the piston valve body into damped engagement with the valve stop.

In another configuration, the second control valve spring causes the piston valve body to be biased into damped engagement with the valve stop when the piston valve body is in the first sub-interval, in addition to whenever the piston valve body is in the second sub-interval.

The control valve assembly of the present invention has many useful applications. One such application is to use the control valve assembly in a fuel pump or fuel injector for a fuel injection system for an internal combustion engine.

A pump, constructed according to the present invention, comprises a pump body having a pumping chamber, a fuel inlet for supplying fuel to the pumping chamber, an output port, and a control valve chamber between the pumping chamber and the outlet port. A reciprocating plunger is disposed in the pumping chamber. The plunger is reciprocatable over a stroke range between an extended position and a retracted position.

The pump further comprises an actuatable control valve for controlling fuel. The control valve is disposed in the control valve chamber, and the control valve includes a piston valve body axially movable over a motion displacement interval between first and second positions within the control valve chamber. The motion displacement interval is defined by first and second sub-intervals bounded by the first and second positions, respectively. The piston valve body includes a piston valve body seat. The piston valve body seat contacts a pump body seating surface whenever the piston valve body is in the first position.

The pump further comprises a stator assembly, and means for actuating the control valve, such as an electromagnetic actuator or solenoid, disposed in the stator assembly. The piston valve body is urged toward an actuated position whenever the control valve is in an actuated state.

An armature is secured to the control valve, and a valve stop is disposed in the pump body adjacent the control valve chamber. The piston valve body seat contacts the valve stop whenever the piston valve body is in the second position.

Further in accordance with the control valve assembly of the present invention, a first control valve spring causes the piston valve body to be biased toward the unactuated position whenever the piston valve body is in the first sub-interval. A second control valve spring causes the piston valve body to be biased into damped engagement with the valve stop whenever the piston valve body is in the second sub-interval.

A stop plate secures the valve stop within the pump body. A stator spacer is disposed between the pump body and the stator assembly and has a central opening for receiving the armature therein. A plurality of fasteners mount the stator assembly and the stator spacer on the pump body. Upon actuation of the control valve, the piston valve body is urged to the actuated position against the biasing of the first control valve spring.

In another embodiment of a control valve assembly, a piston is received in the piston valve body. The piston has first and second ends, and a periphery surface. The first end abuts the valve stop; the second end abuts an end of the second control valve spring. The second control valve spring is received in the piston valve body. The piston has a flow passage in the form of a slot, or plurality of radially and/or axially sequenced ports, for accommodating fluid flow formed on the periphery surface of the piston. The flow passage extends from the second end toward the first end. The flow passage extends outboard of the piston valve body whenever the piston valve body is in the first subinterval. The flow passage is enclosed by the piston valve body whenever the piston valve body is in the second sub-interval. When the flow passage is enclosed by the piston valve body, fluid flow is restricted thereby dampening the engagement of the piston valve body with said valve stop.

Alternatively, a method for controlling rate of displacement of the control valve is provided. In an electromagnetically actuated control valve assembly, the electric current can be precisely controlled to cause the piston valve body movement to model the piston valve body movement for the previously described control valve assemblies.

The advantages accruing to the present invention are numerous. For example, the control valve assembly or method of the present invention can be used in pumps or injectors having either a vertical or horizontal orientated plunger.

The above objects and other objects, features, and advantages of the present invention will be readily appreciated by one of ordinary skill in the art from the following detailed description of the best mode for carrying out the invention when taken in connection with the accompanying drawings.

BEST MODES FOR CARRYING OUT THE INVENTION

Figure 1:
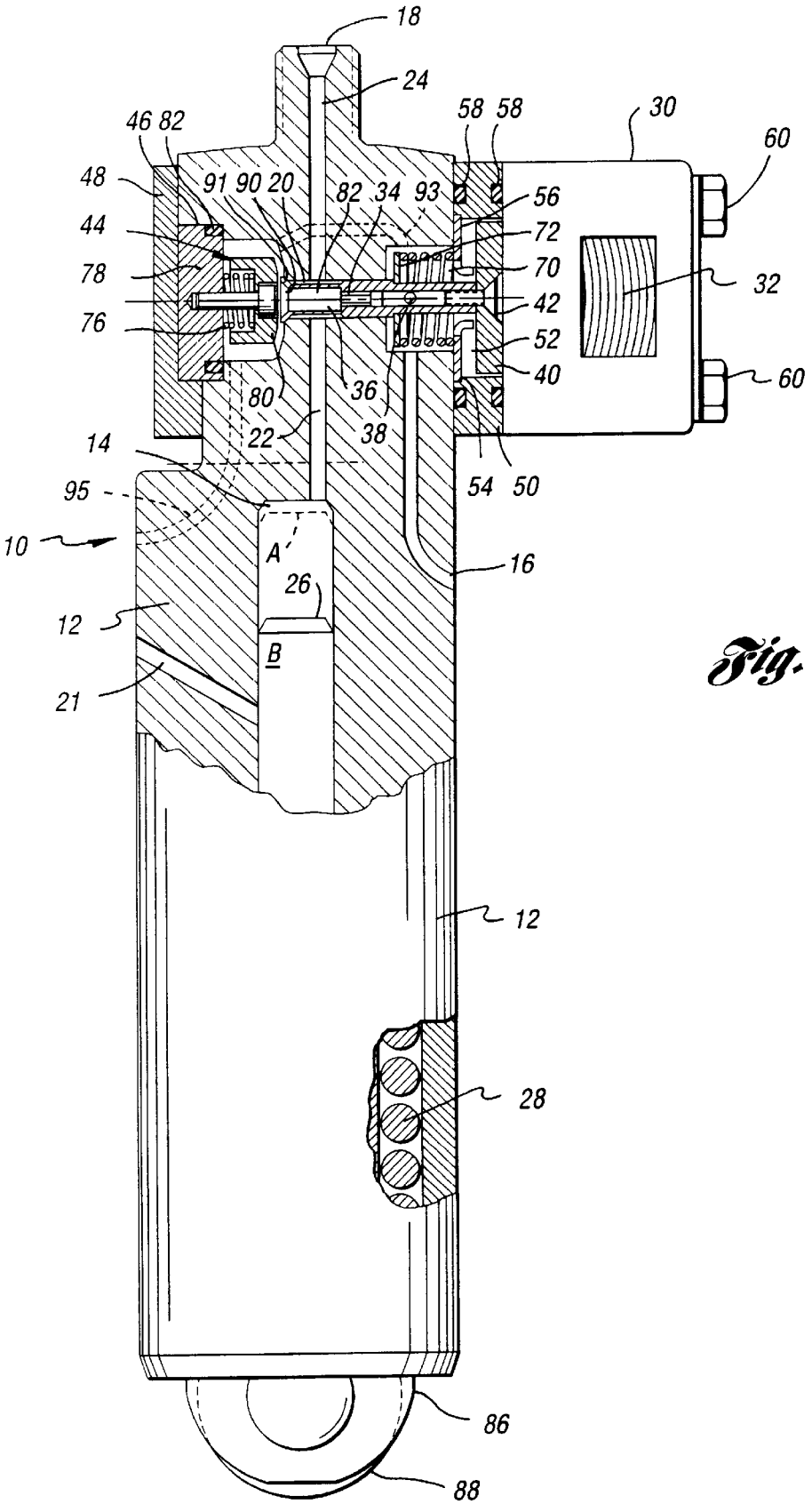
FIG. 1 is a side elevation, partially in section, of a pump for a fuel injection system, the pump having a first embodiment of a control valve assembly made in accordance with the present invention.

Referring now to FIG. 1, a pump 10 including a first embodiment of a control valve assembly made in accordance with the present invention is illustrated. The pump 10 has a pump body 12, and a pumping chamber 14 is enclosed by pump body 12. A fuel inlet 16 for supplying fuel to pump 10 is located on the periphery of pump body 12. Pump body 12 further has an outlet port 18, and a control valve chamber 20 between pumping chamber 14 and outlet port 18. Passageways 22 and 24 connect pumping chamber 14, control valve chamber 20, and outlet port 18, respectively.

A reciprocating plunger 26 is disposed in pumping chamber 14. Plunger 26 is reciprocatable over a stroke range between an extended position indicated at A in dashed line and a retracted position indicated at B. A plunger spring 28 resiliently biases plunger 26 to the retracted position B.

A stator assembly 30 contains an electromagnetic actuator 32, such as a solenoid. An electromagnetically actuated control valve 34 is disposed in control valve chamber 20 for controlling fuel. Control valve 34 includes a piston valve body 36. Piston valve body 36 is movable between an unactuated position and an actuated position within control valve chamber 20. Control valve 34 contains internal passageways 38 for establishing a pressure balance at the inlet and outlet ends of the control valve 34. An armature 40 is secured to control valve 34 by a fastener such as a screw 42.

A valve stop generally designated 44, is disposed in pump body 12 adjacent to control valve chamber 20. An O-ring 46 encircles valve stop 44 to prevent fuel leakage. A stop plate 48 secures valve stop 44 within pump body 12.

A stator spacer 50 having a central opening 52 for receiving armature 40 therein is disposed between pump body 12 and stator assembly 30. Stator spacer 50 has notches 54 for receiving a retainer 56. O-rings 58 seal stator spacer 50 against stator assembly 30 and pump body 12. Fasteners 60 mount stator assembly 30 and stator spacer 50 on pump body 12.

Figure 2:
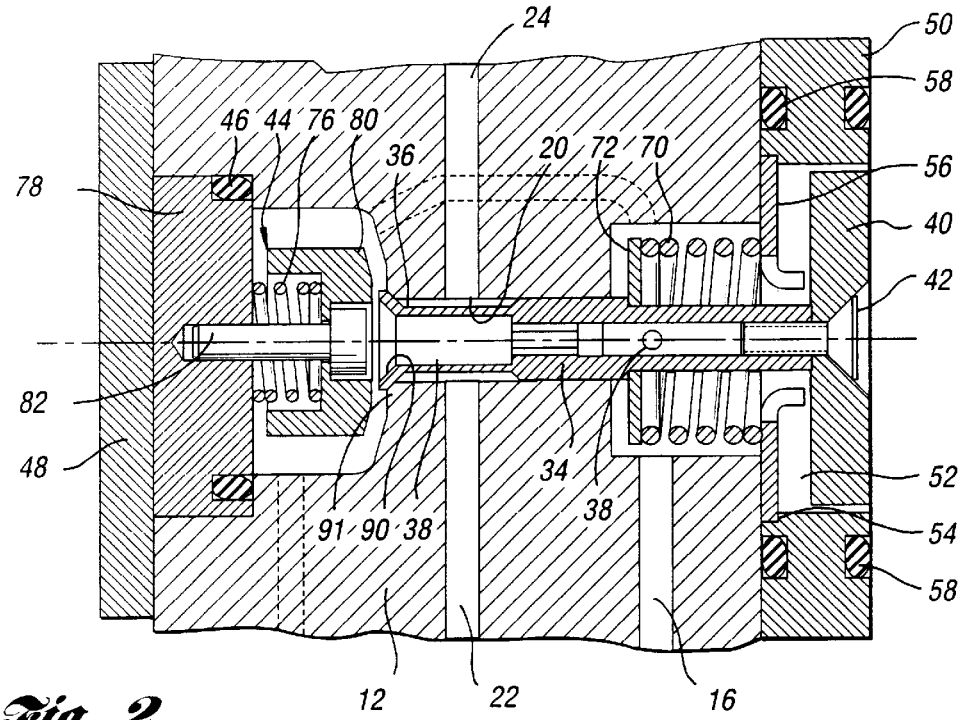
FIG. 2 is an enlarged cross-sectional view of the control valve assembly of FIG. 1.

With reference to FIGS. 1 and 2, the control valve assembly will be further described. Piston valve body 36 is axially movable over a motion displacement interval between first and second positions within control valve chamber 20. The actuated position of piston valve body 36 is one of the first and second positions, and the unactuated position is the other of the first and second positions. Piston valve body 36 is urged toward the actuated position whenever control valve 34 is in the actuated state. The motion displacement interval for piston valve body 36 is defined by first and second sub-intervals defined by the first and second positions for piston valve body 36, respectively.

A first control valve spring 70 resiliently biases piston valve body 36 toward the unactuated position whenever piston valve body 36 is in the first sub-interval. A spring seat 72 and retainer 56 abut first and second ends of first control valve spring 70. A second control valve spring 76 resiliently biases piston valve body 36 into damped engagement with valve stop 44 whenever piston valve body 36 is in the second sub-interval. Valve stop 44 includes a valve stop base 78 and a valve stop head 80. A pin 82 retains valve stop head 80. Second control valve spring 76 encircles pin 82 and is held between valve stop base 78 and the valve stop head 80.

With further reference to FIG. 1, an engagement surface 86 engages a reciprocal drive member, such as a cam 88. The reciprocal motion imparted to engagement surface 86 is transferred to plunger 26 in a conventional manner.

With continuing reference to FIGS. 1 and 2, piston valve body 36 is axially movable over the motion displacement interval between the first and second positions. Piston valve body 36 includes a piston valve body seat 90. Seat 90 contacts a pump body seating surface 91 whenever piston valve body 36 is in the first position and contacts valve stop head 80 whenever piston valve body 36 is in the second position.

First control valve spring 70 is resiliently biasing the piston valve body 36 toward the unactuated position whenever piston valve body 36 is in the first sub-interval of the motion displacement interval. Second control valve spring 76 resiliently biases piston valve body 36 toward either the first position or the second position so as to resiliently bias piston valve body 36 into damped engagement with valve stop 44 whenever piston valve body 36 is in the second sub-interval of the motion displacement interval.

As shown in FIG. 2, the second position of piston valve body 36 is the unactuated position. First control valve spring 70 resiliently biases piston valve body 36 toward the unactuated position, that is, toward valve stop head 80. Second control valve spring 76 resiliently biases piston valve body 36 to slow and dampen the engagement of piston valve body 36 with valve stop head 80.

Figure 3:
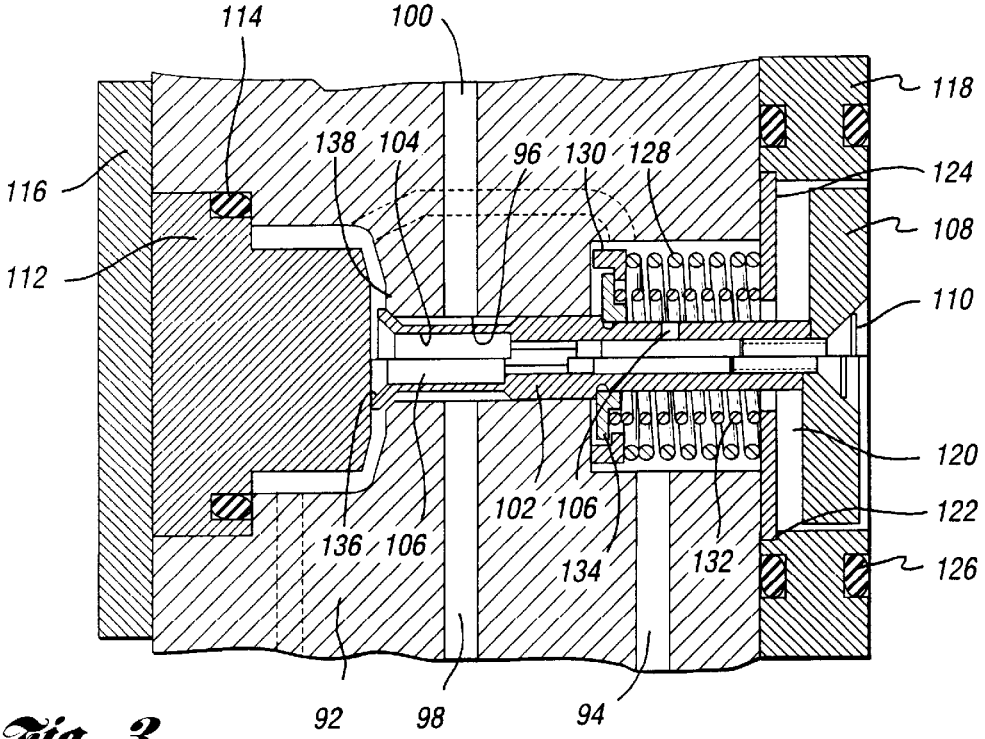
FIG. 3 is an enlarged cross-sectional view of a second embodiment of a control valve assembly of the present invention, and showing the valve in open position (lower half) and closed (upper half)

With reference to FIG. 3, a second embodiment of a control valve assembly will be described. A pump body 92 has a fuel inlet 94, a control valve chamber 96, and passageways 98 and 100 for fuel flow. A control valve 102 having a piston valve body 104 is disposed in control valve chamber 96. Internal passageways 106 are provided for establishing a pressure balance across the control valve 102. In a known manner, as shown in FIGS. 1–5 and described immediately below with reference to FIG. 1, other internal passageways, such as passageway 93 shown in hidden line to provide fuel at an equalized, relatively lower pressure to the chamber surrounding the first control valve spring 70, into central opening 52, into 38, through the internal passageways in the control valve 34, and into the chamber surrounding stop 44 and second control valve spring 76. It will be further appreciated that internal passageways are similarly provided in each of the control valve assembly embodiments illustrated in FIGS. 3–6 as required to implement fuel flow at an equalized pressure.

With continuing reference to FIG. 3, an armature 108 is secured to control valve 102 by a fastener, such as a screw 110. A valve stop 112 is disposed in pump body 92 adjacent control valve chamber 96. Piston valve body 104 contacts valve stop 112 whenever piston valve body 104 is in the second position, as shown in the lower half of FIG. 3. An O-ring 114 encircles valve stop 112. A stop plate 116 secures valve stop 112 within pump body 92.

A stator spacer 118 has a central opening 120 for receiving armature 108 therein. Stator spacer 118 has notches 122 for receiving a retainer 124. O-rings 126 seal stator spacer 118 against pump body 92 and stator assembly 30. A first control valve spring 128 resiliently biases piston valve body 104 toward valve stop 112. A seat 130 is provided for first control valve spring 128. Second control valve spring 132 is concentrically disposed with first spring 128 and resiliently biases piston valve body 104 toward valve stop 112. Second control valve spring 132 is provided with a seat 134 on the control valve 102.

The second position for piston valve body 104 is the unactuated position. The first control valve spring 128 resiliently biases piston valve body 104 toward the unactuated position, that is, toward valve stop 112. Seat 130 is shaped so that first control valve spring 128 biases piston valve body 104 whenever piston valve body 104 is in the first sub-interval. The second control valve spring 132 resiliently biases piston valve body 104 toward valve stop 112 to slow and dampen the engagement of piston valve body 104 with valve stop 112. Seat 134 is shaped so that the second control valve spring 132 always biases piston valve body 104 in the first and second sub-intervals.

Figure 4A:
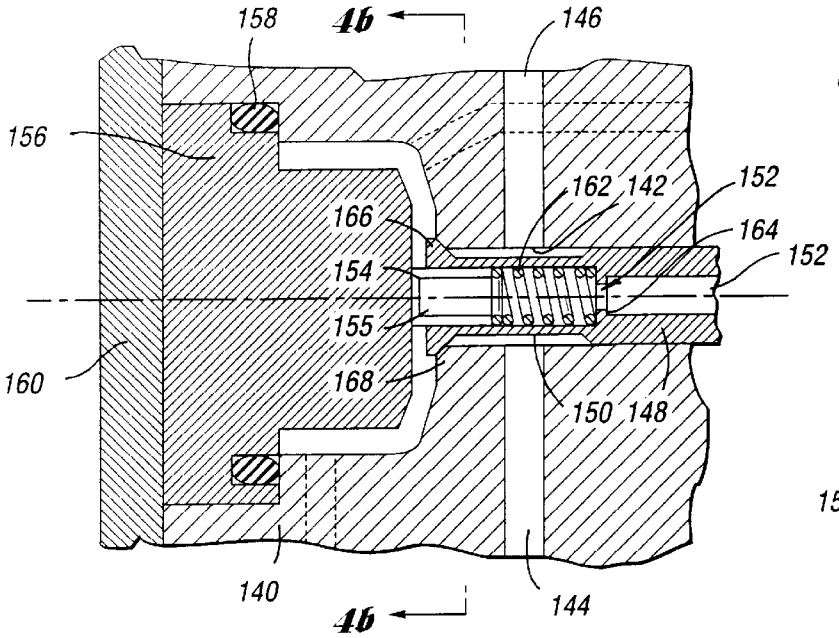
FIG. 4*a* is an enlarged cross-sectional view of a third embodiment of a control valve assembly of the present invention.
Figure 4B:
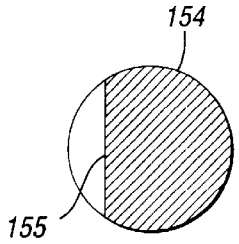
FIG. 4*b* is an enlarged cross-sectional view of the piston shown in FIG. 4*a*, taken along line 4*b*—4*b* of FIG. 4*a;*

With reference to FIGS. 4*a* and 4*b*, a third embodiment of a control valve assembly will be described. A pump body 140 has a control valve chamber 142, and passageways 144 and 146. A control valve 148 having a piston valve body 150 is disposed in control valve chamber 142. As with previous embodiments, internal passageways 152 are provided for establishing a pressure balance across the valve. Again, additional internal passageways are provided, as indicated by hidden lines, to provide fuel flow at an equalized pressure as desired.

A piston 154 having a flow passage in the form of a slot or flat 155 on its periphery, is disposed in piston valve body 150. A valve stop 156 is disposed in pump body 140 adjacent control valve chamber 142. An O-ring 158 encircles valve stop 156. A stop plate 160 secures valve stop 156 within pump body 140. A second control valve spring 162 is disposed within piston valve body 150. Second control valve spring 162 has a seat 164.

Figure 4C:
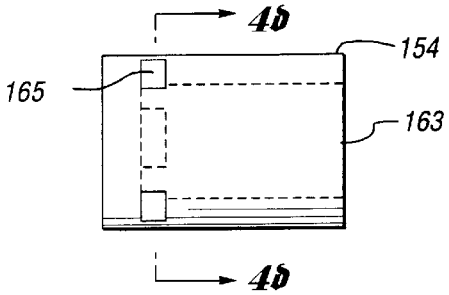
FIG. 4*c* is a side elevation view of an alternative piston as may be employed in the embodiment of FIG. 4*a;*
Figure 4D:
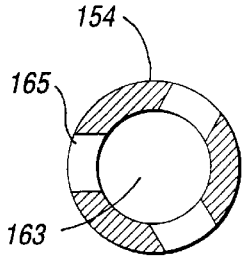
FIG. 4*d* is a cross-sectional view of the piston shown in FIG. 4*c*, taken along line 4*d*—4*d* of FIG. 4*c;*

As shown in FIGS. 4*c* and 4*d*, the flow passage may be provided by boring the piston 154 from one end only and provided radial directed flow passages 165 in fluid communication with the bore 163.

As piston valve body 150 approaches the second position, flow passage 155 is closed off. By reducing the fluid flow, a dampening effect is created.

Figure 5:
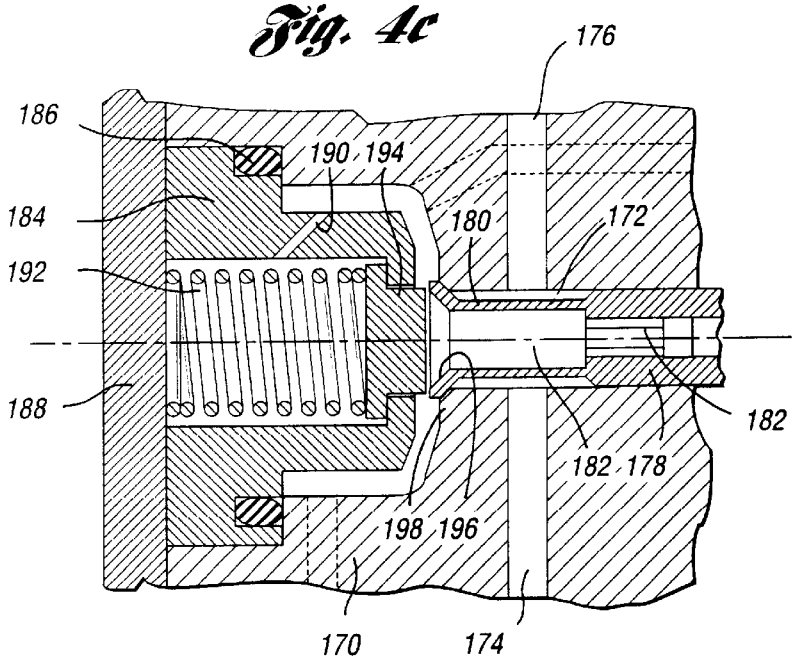
FIG. 5 is an enlarged cross-sectional view of a fourth embodiment of a control valve assembly of the present invention.

With reference to FIG. 5, a fourth embodiment of a control valve assembly is shown. A pump body 170 has a control valve chamber 172, and passageways 174 and 176. A control valve 178 having a piston valve body 180 is disposed in control valve chamber 172. Internal passageways 182 are provided for pressure equalization across the control valve. A cylindrical valve stop 184 is disposed in pump body 170. An O-ring 186 encircles valve stop 184. A stop plate 188 secures valve stop 184 within pump body 170. Passageway 190 is provided in valve stop 184 for venting fluid flow, and, as previously described, additional passageways, shown in hidden lines are typically provided to allow for fuel flow, either directly or indirectly from pump inlet 16 into the chamber 191 surrounding the valve stop 184. A second control valve spring 192 is provided for dampening the engagement of piston valve body 180 with valve stop 184. A seat 194 abuts an end of second control valve spring 192.

Figure 6:
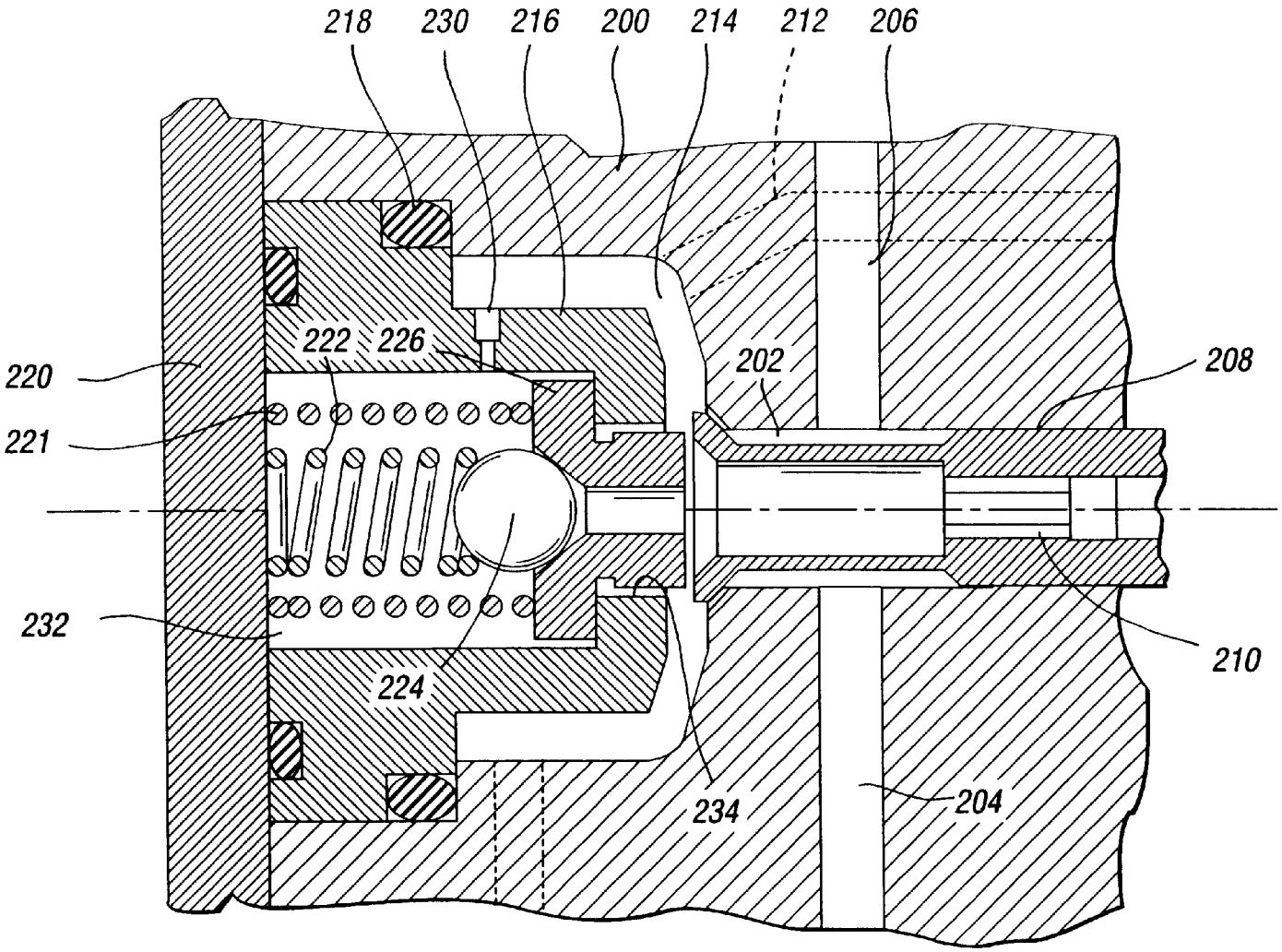
FIG. 6 is an enlarged cross-sectional view of a fifth embodiment of a control valve assembly of the present invention.

With reference to FIG. 6, a fifth embodiment of a control valve assembly is shown. A pump body 200 includes a control valve chamber 202 and fuel passageways 204 and 206. A control valve 208 disposed in the control valve chamber 202. As with the other illustrated embodiments, internal passageways 210 are provided for pressure equalization across the control valve. And, also similar with the other embodiments, other internal passageways 212 are provided for effecting fuel flow, either directly or indirectly from the fuel inlet of the pump to the valve stop chamber 214, as well as from the valve stop chamber 214 to the fuel pump outlet (shown in FIG. 1).

A cylindrical valve stop 216 is disposed in pump body 200. An 0 ring 218 encircles the valve stop 216 and a stop plate 220 secures the valve stop 216 within the pump body 200. Two springs, 221 and 222, provide for dampening the engagement of the piston valve body 208 with the valve stop 216. A check ball 224 abuts one end of the spring 222 and is urged into seating contract with valve stop seat 226. Spring 221 provides a relatively higher force (typically about 30% to 70% of the spring force of the first spring 70 (shown in FIG. 1)), than spring 222, which provides an additional, relatively lower force sufficient to seat the check ball 224 in valve seat 226. The valve stop seat 226 is preferably machined to provide a lapped fit (of approximately 1–5 microns diametral clearance) within the aperture 234 in the valve stop 216. Valve stop seat 226 includes an internal passage 228 which allow for fuel flow (when the fuel pressure within the internal passage 228 exceeds the spring force of the check ball 224 and spring. Another passageway 230 is also preferably utilized to provide additional damping, by restricting exit flow as the valve seat stop 226 is moved into chamber 232 by valve 208.

Operation of pump 10 will now be described with reference to FIG. 1. Fuel is received from a fuel supply, typically through a supply passageway in the engine block, by fuel inlet 16. The fuel flows at a relatively low pressure into the chamber surrounding first control valve spring 70, into central opening 52, into opening 38, through internal passageways in the control valve 34, and into the chamber surrounding valve stop 44 and second control valve spring 76. The fuel typically flows between the chambers via other internal passageways such as passageway 93. Excess fuel is vented through an outlet, such as passageway 95, which typically communicates with a fuel outlet passage in the engine block (not shown).

Fuel is likewise supplied at a relatively low pressure through passage 22 into pumping chamber 14 whenever piston valve body 36 is moved into the second position in contact with valve stop head 80. It will be appreciated that it is well known to those skilled in the art to provide suitable internal passageways within the pump as required to supply fuel at low pressure as described above.

The cam 88 drives engagement surface 86. When desired, the piston valve body 36 of the control valve 34 is moved into the first position in contact with the pump body seating surface 91, and plunger 26 is moved from the retracted position B to the extended position A, thereby momentarily isolating the fuel in the pumping chamber and further pressurizing the fuel within the pumping chamber 14. The control valve 34 is controlled by the electromagnetic actuator 32 to provide the pressurized fuel as and when required to be directed through outlet port 18 by way of passageways 22 and 24.

Figure 7A:
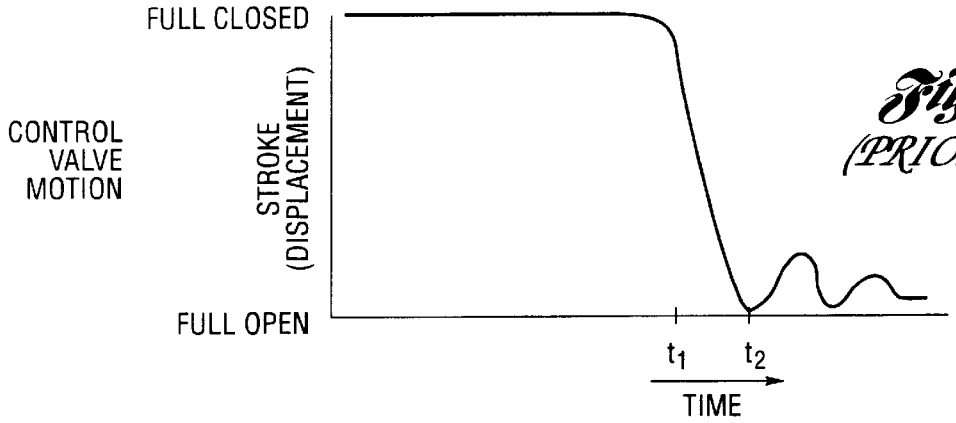
Fig. 7a (PRIOR ART)
FIG. 7*a* is a graph illustrating piston valve body displacement versus time during operation of a control valve assembly according to a method of the prior art.

Referring to FIG. 7*a*, there is shown a graph of piston valve body displacement versus time during operation of the control valve assembly according to a method of the prior art. In the full closed position, the piston valve body seat contacts the pump body seating surface. In the full open position, the piston valve body seat contacts the valve stop. At time t, the solenoid current is discontinued and the piston valve body is urged from the full closed position toward the full open position, initially contacting valve stop at time $t_2$, experiencing thereafter some degree of bounce off the valve stop in cyclic diminishing fashion as shown.

Figure 7B:
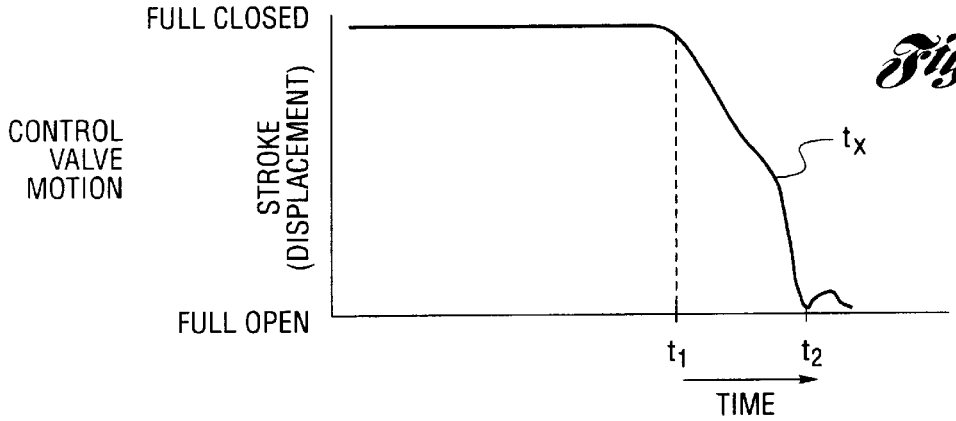
FIGS. 7*b* and 7*c* are graphs illustrating piston valve body displacement versus time during operation of a control valve assembly according to the present invention as depicted by all its embodiments, including the mechanical control arrangements of FIGS. 2–6, and the electronic control arrangement described herein.
Figure 7C:
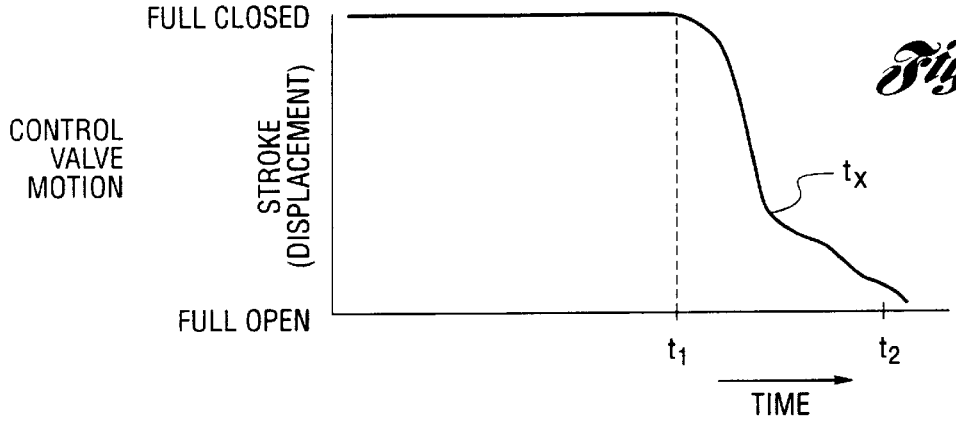

According to the present invention as shown in FIGS. 7*b* and 7*c*, at time $t_2$, the second control valve spring comes into play, either exclusively as shown in FIG. 7*b* or jointly with the first valve spring, as shown in FIG. 7*c*, thereby urging the piston valve body into a delayed, damped engagement with the valve stop. In the prior art, without a second control valve spring, or equivalent dampening means, such as the above-described piston with flow passage arrangement, valve "bounce" is observed as the piston valve body settles into engagement with the valve stop.

Alternatively, by precisely monitoring the current through the electromagnetic actuator, the mechanical control valve assembly can be modeled electrically. Further, damping of the control valve at one or both ends of its stroke is controlled electronically by adjusting current levels to the control valve armature coil and the one of this control technique particularly in pilot injection type fuel injection systems thereby facilitating precise control over the initiation of the main injection by the precise control of the end of the preceding pilot injection illustrated as $t_2$ in FIGS. 7*b* and 7*c*.

Additionally, one may use any one of the embodiments described in FIGS. 2 through 6, or its equivalent, in combination with the technique of adjusting the current levels to the control valve actuating coil.

With reference to FIGS. 2–6, the motion displacement interval and defining sub-intervals for the piston valve body will now be further described. In the first sub-interval, the piston valve body is held in the first position either by the first control valve spring or the induced force from the electromagnetic actuator. If the piston valve body is held in the first position by the first control valve spring, then by actuation of the electromagnetic actuator, the piston valve body is urged toward the second position. If the piston valve body is held in the first position by the induced force from the electromagnetic actuator, then the piston valve body is urged toward the second position by the first control valve spring upon deactuation. As the piston valve body approaches the second position in either one of the previously described manners, the piston valve body moves through the first sub-interval.

Upon entering the second sub-interval, the piston valve body is in close proximity with the valve stop. In the second sub-interval, the second control valve spring, being configured to apply force in the appropriate direction to bring the piston valve body into delayed engagement with the valve stop, causes the piston valve body to be biased. Alternatively, as previously described, the control valve assembly can be provided with the piston-auxiliary fuel flow arrangement, or further controlled electrically.

It is to be understood that while the forms of the invention described above constitute the preferred embodiment of the invention, the preceding description is not intended to illustrate all possible forms thereof. For example, it will be recognized that many design features of the foregoing unit pump are equally applicable to a unit fuel injector, as shown for example in U.S. Pat. No. 4,618,095 assigned to the assignee of the present invention, and incorporated herein by reference. By referring herein to a pump, applicant includes a unit fuel injector. It is also to be understood that the words used are words of description, rather than limitation, and that various changes may be made without departing from the spirit and scope of the invention, which should be construed according to the following claims.

What is claimed is:

1. A pump for a fuel injection system, the pump comprising:

a pump body having a pumping chamber, a fuel inlet for supplying fuel to said pumping chamber, an output port, and a control valve chamber between said pumping chamber and said outlet port;

a reciprocating plunger disposed in said pumping chamber, said plunger being reciprocatable over a stroke range between an extended position and a retracted position;

an actuatable control valve assembly for controlling fuel, said control valve assembly being disposed in said control valve chamber, and said control valve assembly including a piston valve body axially movable over a motion displacement interval between first and second positions within said control valve chamber, said motion displacement interval being defined by first and second sub-intervals bounded by said first and second positions, respectively;

an electromagnetic actuator for actuating said control valve assembly, wherein said piston valve body is urged toward an actuated position whenever said control valve is in an actuated state, said actuated position being one of said first and second positions, and a deactuated position being the other of said first and second positions;

a valve stop disposed in said pump body adjacent said control valve chamber, said piston valve body contacting said valve stop whenever said piston valve body is in said second position;

a first control valve spring positioned to cause said piston valve body to be biased toward said unactuated position whenever said piston valve body is in said first sub-interval; and a second control valve spring positioned to cause said piston valve body to be biased into damped engagement with said valve stop whenever said piston valve body is in said second sub-interval.

2. The pump of claim 1 wherein said actuated position is said first position, whereby upon deactuation of said control valve, said piston valve body is urged toward said unactuated position and into damped engagement with said valve stop.

3. The pump of claim 1 wherein said first control valve spring causes said piston valve body to be biased toward said second position when said piston valve body is in said second sub-interval.

4. The pump of claim 1 wherein said second control valve spring causes said piston valve body to be biased toward said first position when said piston valve body is in said second sub-interval.

5. The pump of claim 1 wherein said second control valve spring causes said piston valve body to be biased toward said second position when said piston valve body is in said second sub-interval.

6. The pump of claim 1 wherein said second control valve spring biases said piston valve body when said piston valve body is in said first sub-interval.

7. The pump of claim 1 wherein said second control valve spring is encircled by said valve stop.

8. The pump of claim 1 further comprising:

a piston received in said piston valve body, said piston having first and second ends and a periphery surface, said first end abutting said valve stop, said second end abutting an end of said second control valve spring, said second control valve spring being received in said piston valve body, said piston having a passage for accommodating fuel flow and being formed in communication with the periphery surface of said piston, and said passage extending outboard of said piston valve body whenever said piston valve body is in said first sub-interval, and said passage being enclosed by said piston valve body whenever said piston valve body is in said second sub-interval, whereby when said passage is enclosed by said piston valve body, fuel flow is restricted thereby dampening the engagement of said piston valve body with said valve stop.

9. The pump of claim 1 wherein the valve stop further comprises:

a valve stop body encircling the second control valve spring and defining a cavity, the valve stop body further defining an annular opening and a pressure relief passage in fluid flow communication with the cavity;

a valve stop seat received in the annular opening for contacting the piston valve body, wherein the second control valve spring is arranged to urge the valve stop seat through the annular opening and into damped engagement with the piston valve body, the valve stop seat having an annular opening to provide fluid flow communication with the cavity;

a check ball positioned within the valve stop body and at the valve stop seat annular opening; and a check ball spring positioned to urge the check ball toward the valve stop seat annular opening to form a check valve such that the fluid flow through the pressure relief passage damps movement of the piston valve body toward the valve stop body when the piston valve body contacts the valve stop seat.

10. A control valve assembly comprising:

a housing having a control valve chamber;

a control valve assembly disposed in said control valve chamber, said control valve assembly including a piston valve body axially movable over a motion displacement interval between first and second positions within said control valve chamber, said motion displacement interval being defined by first and second sub-intervals bounded by said first and second positions, respectively;

a valve stop disposed in said housing adjacent said control valve chamber, said piston valve body contacting said valve stop whenever said piston valve body is in said second position;

a first control valve spring positioned to cause said piston valve body to be biased toward said second position whenever said piston valve body is in said first sub-interval; and a second control valve spring positioned to cause said piston valve body to be biased into damped engagement with said valve stop whenever said piston valve body is in said second sub-interval.

11. The control valve assembly of claim 10 wherein said first control valve spring causes said piston valve body to be biased toward said second position when said piston valve body is in said second sub-interval.

12. The control valve assembly of claim 10 wherein said second control valve spring causes said piston valve body to be biased toward said first position when said piston valve body is in said second sub-interval.

13. The control valve assembly of claim 10 wherein said second control valve spring causes said piston valve body to be biased toward said second position when said piston valve body is in said second sub-interval.

14. The control valve assembly of claim 10 wherein said second control valve spring biases said piston valve body when said piston valve body is in said first sub-interval.

15. The control valve assembly of claim 10 further comprising:

a piston received in said piston valve body, said piston having first and second ends and a periphery surface, said first end abutting said valve stop, said second end abutting an end of said second control valve spring, said second control valve spring being received in said piston valve body, said piston having a passage for accommodating fluid flow and being formed in communication with the periphery surface of said piston, and said passage extending outboard of said piston valve body whenever said piston valve body is in said first sub-interval, and said passage being enclosed by said piston valve body whenever said piston valve body is in said second sub-interval, whereby when said passage is enclosed by said piston valve body, fluid flow is restricted thereby dampening the engagement of said piston valve body with said valve stop.

16. The control valve assembly of claim 10 wherein the valve stop further comprises:

a valve stop body encircling the second control valve spring and defining a cavity, the valve stop body further defining an annular opening and a pressure relief passage in fluid flow communication with the cavity;

a valve stop seat received in the annular opening for contacting the piston valve body, wherein the second control valve spring is arranged to urge the valve stop seat through the annular opening and into damped engagement with the piston valve body, the valve stop seat having an annular opening to provide fluid flow communication with the cavity;

a check ball positioned within the valve stop body and at the valve stop seat annular opening; and a check ball spring positioned to urge the check ball toward the valve stop seat annular opening to form a check valve such that the fluid flow through the pressure relief passage damps movement of the piston valve body toward the valve stop body when the piston valve body contacts the valve stop seat.

17. A control valve assembly comprising:

a housing having a control valve chamber;

an actuatable control valve assembly disposed in said control valve chamber, said control valve assembly including a piston valve body axially movable over a motion displacement interval between first and second positions within said control valve chamber, said motion displacement interval being defined by first and second sub-intervals bounded by said first and second positions, respectively;

means for actuating said control valve, wherein said piston valve body is urged toward an actuated position whenever said control valve is in an actuated state, said actuated position being one of said first and second positions, and an unactuated position being the other of said first and second positions;

a valve stop disposed in said housing adjacent said control valve chamber, said piston valve body contacting said valve stop whenever said piston valve body is in said second position;

a first control valve spring positioned to cause said piston valve body to be biased toward said unactuated position whenever said piston valve body is in said first sub-interval; and a second control valve spring positioned to cause said piston valve body to be biased into damped engagement with said valve stop whenever said piston valve body is in said second sub-interval.

18. The control valve assembly of claim 17 wherein said actuated position is said first position, whereby upon deactuation of said control valve, said piston valve body is urged toward said unactuated position and into damped engagement with said valve stop.

19. The control valve assembly of claim 17 wherein said first control valve spring causes said piston valve body to be biased toward said second position when said piston valve body is in said second sub-interval.

20. The control valve assembly of claim 17 wherein said second control valve spring causes said piston valve body to be biased toward said first position when said piston valve body is in said second sub-interval.

21. The control valve assembly of claim 17 wherein said second control valve spring causes said piston valve body to be biased toward said second position when said piston valve body is in said second sub-interval.

22. The control valve assembly of claim 17 wherein said second control valve spring biases said piston valve body when said piston valve body is in said first sub-interval.

23. The control valve assembly of claim 17 further comprising:

a piston received in said piston valve body, said piston having first and second ends and a periphery surface, said first end abutting said valve stop, said second end abutting an end of said second control valve spring, said second control valve spring being received in said piston valve body, said piston having a passage for accommodating fluid flow and being formed in communication with the periphery surface of said piston, and said passage extending outboard of said piston valve body whenever said piston valve body is in said first sub-interval, and said passage being enclosed by said piston valve body whenever said piston valve body is in said second sub-interval, whereby when said passage is enclosed by said piston valve body, fluid flow is restricted thereby dampening the engagement of said piston valve body with said valve stop.

24. The control valve assembly of claim 17 wherein the valve stop further comprises:

a valve stop body encircling the second control valve spring and defining a cavity, the valve stop body further defining an annular opening and a pressure relief passage in fluid flow communication with the cavity;

a valve stop seat received in the annular opening for contacting the piston valve body, wherein the second control valve spring is arranged to urge the valve stop seat through the annular opening and into damped engagement with the piston valve body, the valve stop seat having an annular opening to provide fluid flow communication with the cavity;

a check ball positioned within the valve stop body and at the valve stop seat annular opening; and a check ball spring positioned to urge the check ball toward the valve stop seat annular opening to form a check valve such that the fluid flow through the pressure relief passage damps movement of the piston valve body toward the valve stop body when the piston valve body contacts the valve stop seat.

* * * * *